US010361511B1

(12) United States Patent
Peter

(10) Patent No.: US 10,361,511 B1
(45) Date of Patent: Jul. 23, 2019

(54) REMOVAL DELAY FEATURE FOR REMOVABLY CONNECTED DEVICES

(71) Applicant: Western Digital Technologies, Inc., Irvine, CA (US)

(72) Inventor: Eldhose Peter, Bengaluru (IN)

(73) Assignee: WESTERN DIGITAL TECHNOLOGIES, INC., Irvine, CA (US)

( * ) Notice: Subject to any disclaimer, the term of this patent is extended or adjusted under 35 U.S.C. 154(b) by 0 days.

(21) Appl. No.: 16/020,456

(22) Filed: Jun. 27, 2018

(51) Int. Cl.
*H01R 13/26* (2006.01)
*H01R 13/50* (2006.01)
*H01R 13/627* (2006.01)

(52) U.S. Cl.
CPC ..... *H01R 13/6273* (2013.01); *H01R 13/50* (2013.01); *H01R 13/26* (2013.01)

(58) Field of Classification Search
CPC ..... H01R 24/60; H01R 13/6581–6597
USPC ..... 439/660, 607.01–607.58
See application file for complete search history.

(56) References Cited

U.S. PATENT DOCUMENTS 4,376,563 A * 3/1983 Margrave ..... H01R 13/627 439/358
5,376,016 A * 12/1994 Inaba ..... H01R 13/6215 439/357
6,648,669 B1 * 11/2003 Kim ..... H01R 13/6272 439/357
6,934,774 B1 8/2005 Sundaram et al.
8,473,664 B2 6/2013 Stemmer
8,535,097 B2 * 9/2013 Yen ..... H01R 13/6594 439/607.27
9,148,001 B1 * 9/2015 Mohanty ..... H02G 3/00
9,753,673 B1 9/2017 Jenkins et al.
2006/0242362 A1 10/2006 Hanes et al.
2007/0149054 A1 * 6/2007 Watanabe ..... H01R 13/6582 439/607.27
2008/0126595 A1 5/2008 Davis et al.
2008/0171455 A1 * 7/2008 Ko ..... H01R 13/6582 439/101

(Continued)

FOREIGN PATENT DOCUMENTS

CN 1991806 7/2007

OTHER PUBLICATIONS

Kanguru Defender Secure USB Flash Drive, User Manual, 2015, pp. 1-50, Kanguru Solutions, Millis, MA.

(Continued)

*Primary Examiner* — Gary F Paumen
(74) *Attorney, Agent, or Firm* — Kunzler Bean & Adamson

(57) ABSTRACT

An electronic device that comprises a base, an insert housing, and a connector. The insert housing is coupled to the base at a first end and comprises a first side extending in an outward direction from the base. The first side comprises a first retention feature formed in the first side at a first distance from the base and a second retention feature formed in the first side at a second distance from the base. The first distance is less than the second distance. The first side partially defines a second end of the insert housing opposite the first end and open to allow access to an interior of the insert housing. The connector is coupled to the base and disposed within the interior of the insert housing. The connector comprises at least two electrical leads disposed on a surface of the connector accessible through the second end.

24 Claims, 6 Drawing Sheets

(56) References Cited

U.S. PATENT DOCUMENTS

| | | | | |
|---|---|---|---|---|
| 2009/0184932 | A1 | 7/2009 | Alten | |
| 2010/0191945 | A1 | 7/2010 | Poo et al. | |
| 2010/0210119 | A1* | 8/2010 | Bauer | H01R 35/04 439/13 |
| 2011/0083023 | A1* | 4/2011 | Dickens | G06F 1/3209 713/310 |
| 2011/0151716 | A1* | 6/2011 | Kondo | H01R 13/6658 439/607.01 |
| 2013/0166807 | A1 | 6/2013 | Klimecki | |
| 2013/0316568 | A1* | 11/2013 | Yu | H01R 24/60 439/485 |
| 2013/0323978 | A1* | 12/2013 | Ho | H01R 13/04 439/626 |
| 2014/0101345 | A1 | 4/2014 | Ranta | |
| 2015/0268688 | A1* | 9/2015 | Leinonen | G06F 13/409 307/147 |
| 2016/0134051 | A1* | 5/2016 | Zhang | H01R 13/6205 439/39 |
| 2016/0372876 | A1* | 12/2016 | Zhang | H01R 24/62 |
| 2017/0117671 | A1* | 4/2017 | Chang | H01R 13/6581 |
| 2017/0149184 | A1* | 5/2017 | Chuang | H01R 24/64 |
| 2017/0179658 | A1* | 6/2017 | Chuang | H01R 24/60 |

OTHER PUBLICATIONS

Vilches, USB 3.0: What You Need to Know, https://www.techspot.com/guides/235-everything-about-usb-30/accessed Jun. 27, 2018, pp. 1-15.

* cited by examiner

REMOVAL DELAY FEATURE FOR REMOVABLY CONNECTED DEVICES

FIELD

This disclosure relates generally to removably connected devices, and more particularly to removal delay features in universal serial bus connected devices.

BACKGROUND

Universal Serial Bus ("USB") connections are widely used to provide and receive power and data to and from a wide range of electronic devices. One benefit of the USB connection is the relative ease of connecting and disconnecting different electronic devices. These electronic devices include data storage or memory devices. Removing a memory device can cause a write abort error or result in the initiation of a write abort handling protocol, which degrades the lifespan of the memory device.

SUMMARY

A need exists for an electronic device and a system that provides a removal delay feature for write abort reduction in universal serial bus connected memory devices. The subject matter of the present application has been developed in response to the present state of universal serial bus connected devices, and in particular, in response to problems and needs in the art, such as those discussed above, that have not yet been fully solved by currently available universal serial bus connected devices. Accordingly, the embodiments of the present disclosure overcome at least some of the shortcomings of the prior art.

Disclosed here in an electronic device. The electronic device comprises a base. The electronic device also comprises an insert housing coupled to the base at a first end of the insert housing. The insert housing comprises a first side extending in an outward direction from the base. The first side comprises a first retention feature formed in the first side at a first distance from the base and a second retention feature formed in the first side at a second distance from the base. The first distance is less than the second distance. The first side partially defines a second end of the insert housing opposite the first end and open to allow access to an interior of the insert housing. The electronic device further comprises a connector coupled to the base and disposed within the interior of the insert housing. The connector comprises at least two electrical leads disposed on a surface of the connector accessible through the second end of the insert housing. The preceding subject matter of this paragraph characterizes example 1 of the present disclosure.

The first retention feature comprises two primary cutouts in the first side of the insert housing and the second retention feature comprises two secondary cutouts in the first side at least partially aligned with the two primary cutouts in the outward direction. The preceding subject matter of this paragraph characterizes example 2 of the present disclosure, wherein example 2 also includes the subject matter according to example 1, above.

Each of the two secondary cutouts have a width of approximately 2.5 millimeters and a length of approximately 1 millimeter. The width is measured perpendicular to the outward direction and the length is measured parallel to the outward direction. The preceding subject matter of this paragraph characterizes example 3 of the present disclosure, wherein example 3 also includes the subject matter according to example 2, above.

A center of each of the two secondary cutouts is approximately 3 millimeters from the second end of the insert housing and approximately 3 millimeters from a centerline of the first side of the insert housing. The centerline extends in the outward direction from the base along a center of the first side of the insert housing. The preceding subject matter of this paragraph characterizes example 4 of the present disclosure, wherein example 4 also includes the subject matter according to any one of examples 2-3, above.

The center of each of the two secondary cutouts is approximately 2.91 millimeters from the second end of the insert housing. The preceding subject matter of this paragraph characterizes example 5 of the present disclosure, wherein example 5 also includes the subject matter according to example 4 above.

The first retention feature is positioned in the insert housing to retain the electronic device in a fully engaged mode, relative to a receiver configured to receive the electronic device, and the second retention feature is positioned in the insert housing to retain the electronic device in a partially engaged mode, relative to the receiver. The preceding subject matter of this paragraph characterizes example 6 of the present disclosure, wherein example 6 also includes the subject matter according to any one of examples 2-5, above.

The first retention feature and the second retention feature are sized to engage with a retaining feature of the receiver. The preceding subject matter of this paragraph characterizes example 7 of the present disclosure, wherein example 7 also includes the subject matter according to example 6 above.

The at least two electrical leads comprises at least one power lead having a first length and at least one data lead having a second length, wherein the first length is greater than the second length. The preceding subject matter of this paragraph characterizes example 8 of the present disclosure, wherein example 8 also includes the subject matter according to any one of examples 1-7, above.

The first retention feature is positioned in the insert housing to releasably retain both the at least one power lead and the at least one data lead in electrical contact with a receiver configured to receive the electronic device and the second retention feature is positioned in the insert housing to releasably retain the at least one power lead in electrical contact with the receiver and to releasably retain the at least one data lead out of electrical contact with the receiver. The preceding subject matter of this paragraph characterizes example 9 of the present disclosure, wherein example 9 also includes the subject matter according to example 8 above.

The electronic device is configured to perform a power down or protective operation in response to detection that the at least one power lead is in electrical contact with a receiver and detection that the at least one data lead is disconnected from the receiver. The preceding subject matter of this paragraph characterizes example 10 of the present disclosure, wherein example 10 also includes the subject matter according to any one of examples 1-9, above.

At least one of the first retention feature and the second retention feature is also formed in the third side of the insert housing to approximately mirror a position of the at least one of the corresponding first retention feature and the second retention feature formed in the first side of the insert housing. The preceding subject matter of this paragraph characterizes example 11 of the present disclosure, wherein example 11 also includes the subject matter according to any one of examples 1-10, above.

The electronic device further comprises a data storage device. The preceding subject matter of this paragraph characterizes example 12 of the present disclosure, wherein example 12 also includes the subject matter according to any one of examples 1-11, above.

The electronic device further comprises a cable connecting the data storage device to the electronic device. The preceding subject matter of this paragraph characterizes example 13 of the present disclosure, wherein example 13 also includes the subject matter according to any one of examples 1-12, above.

A cable comprises the electronic device. The preceding subject matter of this paragraph characterizes example 14 of the present disclosure, wherein example 14 also includes the subject matter according to any one of examples 1-13, above.

Further disclosed herein is a system. The system comprises a receiver comprising a retaining feature, disposed within the receiver, and an electronic device. The electronic device comprises a first retention feature formed in a first side of the electronic device. The first retention feature is positioned to engage with the retaining feature of the receiver in a fully engaged mode. The electronic device also comprises a second retention feature formed in the first side of the electronic device. The second retention feature is positioned to engage with the retaining feature of the receiver in a partially engaged mode. The electronic device further comprises a connector comprising at least one power lead and at least one data lead disposed on a surface of the connector to electrically connect with the receiver. The at least one power lead and the at least one data lead are in electrical contact with the receiver in the fully engaged mode and the at least one power lead is in electrical contact with the receiver while the at least one data lead is disconnected from the receiver in the partially engaged mode. The preceding subject matter of this paragraph characterizes example 15 of the present disclosure.

The electronic device is a universal serial bus device. The preceding subject matter of this paragraph characterizes example 16 of the present disclosure, wherein example 16 also includes the subject matter according to example 15 above.

The electronic device comprises a data storage device. The preceding subject matter of this paragraph characterizes example 17 of the present disclosure, wherein example 17 also includes the subject matter according to any one of examples 15-16, above.

The at least one power lead comprises a power supply lead and a ground lead and the at least one data lead comprises a positive data lead and a negative data lead. The preceding subject matter of this paragraph characterizes example 18 of the present disclosure, wherein example 18 also includes the subject matter according to any one of examples 15-17, above.

The power supply lead, the ground lead, the positive data lead, and the negative data lead are parallel to one another and the positive data lead and the negative data lead are disposed between the power supply lead and the ground lead. The preceding subject matter of this paragraph characterizes example 19 of the present disclosure, wherein example 19 also includes the subject matter according to example 18 above.

The at least one power lead is approximately 1 mm longer than the at least one data lead. The preceding subject matter of this paragraph characterizes example 20 of the present disclosure, wherein example 20 also includes the subject matter according to any one of examples 15-19, above.

The second retention feature is sized to engage with the retaining feature of the receiver to delay removal of the electronic device from the receiver. The preceding subject matter of this paragraph characterizes example 21 of the present disclosure, wherein example 21 also includes the subject matter according to any one of examples 15-20, above.

The electronic device is configured to perform a power down or protective operation in response to detection that the at least one power lead is in electrical contact with the receiver and detection that the at least one data lead is disconnected from the receiver. The preceding subject matter of this paragraph characterizes example 22 of the present disclosure, wherein example 22 also includes the subject matter according to any one of examples 15-21, above.

The second retention feature is configured to delay the removal of the electronic device from the receiver by up to approximately 100 milliseconds. The preceding subject matter of this paragraph characterizes example 23 of the present disclosure, wherein example 23 also includes the subject matter according to any one of examples 15-22, above.

Additionally disclosed herein is a method comprising engaging an electronic device with a receiver in a fully engaged mode. The fully engaged mode comprises engaging a retaining feature of the receiver with a first retention feature of the electronic device and maintaining electrical contact between at least one data lead and at least one power lead of the electronic device and the receiver. The method also comprises partially withdrawing the electronic device from the receiver to disengage the retaining feature of the receiver from the first retention feature of the electronic device. The method further comprises engaging the retaining feature with a second retention feature of the electronic device in a partially engaged mode. The partially engaged mode comprises maintaining electrical contact of the at least one power lead of the electronic device with the receiver and electrically disconnecting the at least one data lead of the electronic device from the receiver. The preceding subject matter of this paragraph characterizes example 24 of the present disclosure.

The described features, structures, advantages, and/or characteristics of the subject matter of the present disclosure may be combined in any suitable manner in one or more embodiments and/or implementations. In the following description, numerous specific details are provided to impart a thorough understanding of embodiments of the subject matter of the present disclosure. One skilled in the relevant art will recognize that the subject matter of the present disclosure may be practiced without one or more of the specific features, details, components, materials, and/or methods of a particular embodiment or implementation. In other instances, additional features and advantages may be recognized in certain embodiments and/or implementations that may not be present in all embodiments or implementations. Further, in some instances, well-known structures, materials, or operations are not shown or described in detail to avoid obscuring aspects of the subject matter of the present disclosure. The features and advantages of the subject matter of the present disclosure will become more fully apparent from the following description and appended claims or may be learned by the practice of the subject matter as set forth hereinafter.

BRIEF DESCRIPTION OF THE DRAWINGS

In order that the advantages of the disclosure will be readily understood, a more particular description of the disclosure briefly described above will be rendered by reference to specific embodiments that are illustrated in the appended drawings. Understanding that these drawings depict only typical embodiments of the disclosure and are not therefore to be considered to be limiting of its scope, the subject matter of the present application will be described and explained with additional specificity and detail through the use of the accompanying drawings, in which.

DETAILED DESCRIPTION

Reference throughout this specification to "one embodiment," "an embodiment," or similar language means that a particular feature, structure, or characteristic described in connection with the embodiment is included in at least one embodiment of the present disclosure. Appearances of the phrases "in one embodiment," "in an embodiment," and similar language throughout this specification may, but do not necessarily, all refer to the same embodiment. Similarly, the use of the term "implementation" means an implementation having a particular feature, structure, or characteristic described in connection with one or more embodiments of the present disclosure, however, absent an express correlation to indicate otherwise, an implementation may be associated with one or more embodiments.

Figure 1:
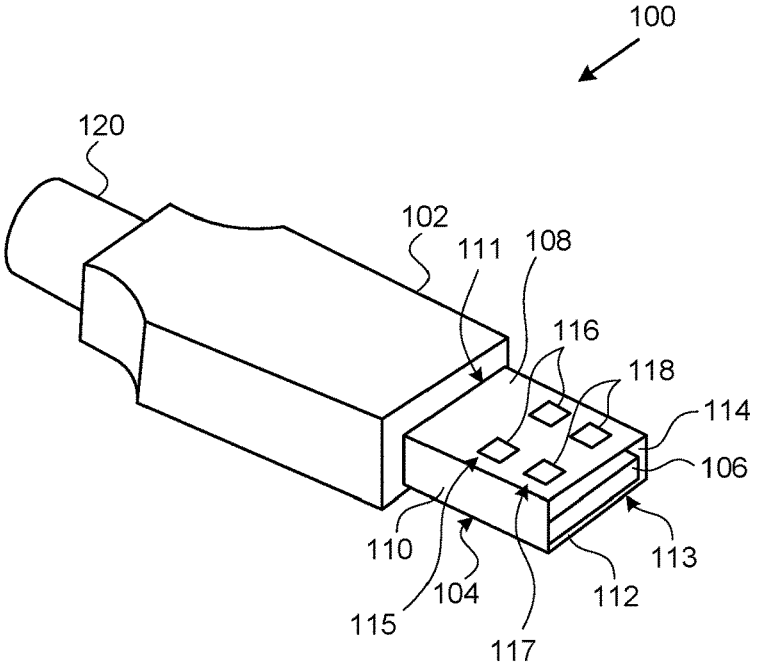
FIG. 1 is a perspective view of an electronic device, according to one or more examples of the present disclosure.

Referring to FIG. 1, an electronic device 100, according to one embodiment, is depicted as a universal serial bus connection or a universal serial bus based device, which may be a data storage or memory device or system, or an electronic device that sends and/or receives data in its operations. However, the electronic device 100 may be one of various connection types without departing from the essence of the subject matter of the present disclosure. The illustrated embodiment of the electronic device 100 includes a base 102, an insert housing 104, and a connector 106. The insert housing 104 is coupled to the base 102 at a first end 111 of the insert housing 104. The connector 106 is also coupled to the base 102 and is disposed within an interior of the insert housing 104.

The insert housing 104 includes a first side 108 which extends in an outward direction from the base 102. The insert housing 104 also includes a second side 110 extending in the outward direction from the base 102. The second side 110 is coupled to the first side 108 at a right angle relative to the first side 108. The insert housing 104 also includes a third side 112 extending in the outward direction from the base 102, parallel to the first side 108, and coupled to the second side 110 at a right angle relative to the second side 110. The insert housing 104 also includes a fourth side 114 extending in the outward direction from the base 102, parallel to the second side 110, and coupled to the first side 108 and the third side 112 at right angles, respectively. The fourth side 114, the first side 108, the second side 110, and the third side 112 form a second end 113 of the insert housing 104 away from the base 102 and the first end 111 of the insert housing 104 at the base 102. In other words, the second end 113 of the insert housing 104 is open to allow access to an interior of the insert housing 104 and thus the connector 106.

The first side 108 of the insert housing 104 includes a first retention feature 115 formed in the first side 108 at a first distance from the base 102. The first side 108 also includes a second retention feature 117 formed in the first side 108 of the insert housing 104 at a second distance from the base 102. The first distance is less than the second distance.

In some embodiments, the first retention feature 115 includes two primary cutouts 116 in the first side 108 of the insert housing 104. In the illustrated embodiment, the second retention feature 117 includes two secondary cutouts 118 in the first side 108 of the insert housing 104. The primary cutouts 116 of the first retention feature 115 may be aligned with the secondary cutouts 118 of the second retention feature 117. In some embodiments, at least one of the first retention feature 115 and the second retention feature 117 also includes cutouts in the third side 112 of the insert housing 104.

Figure 4:
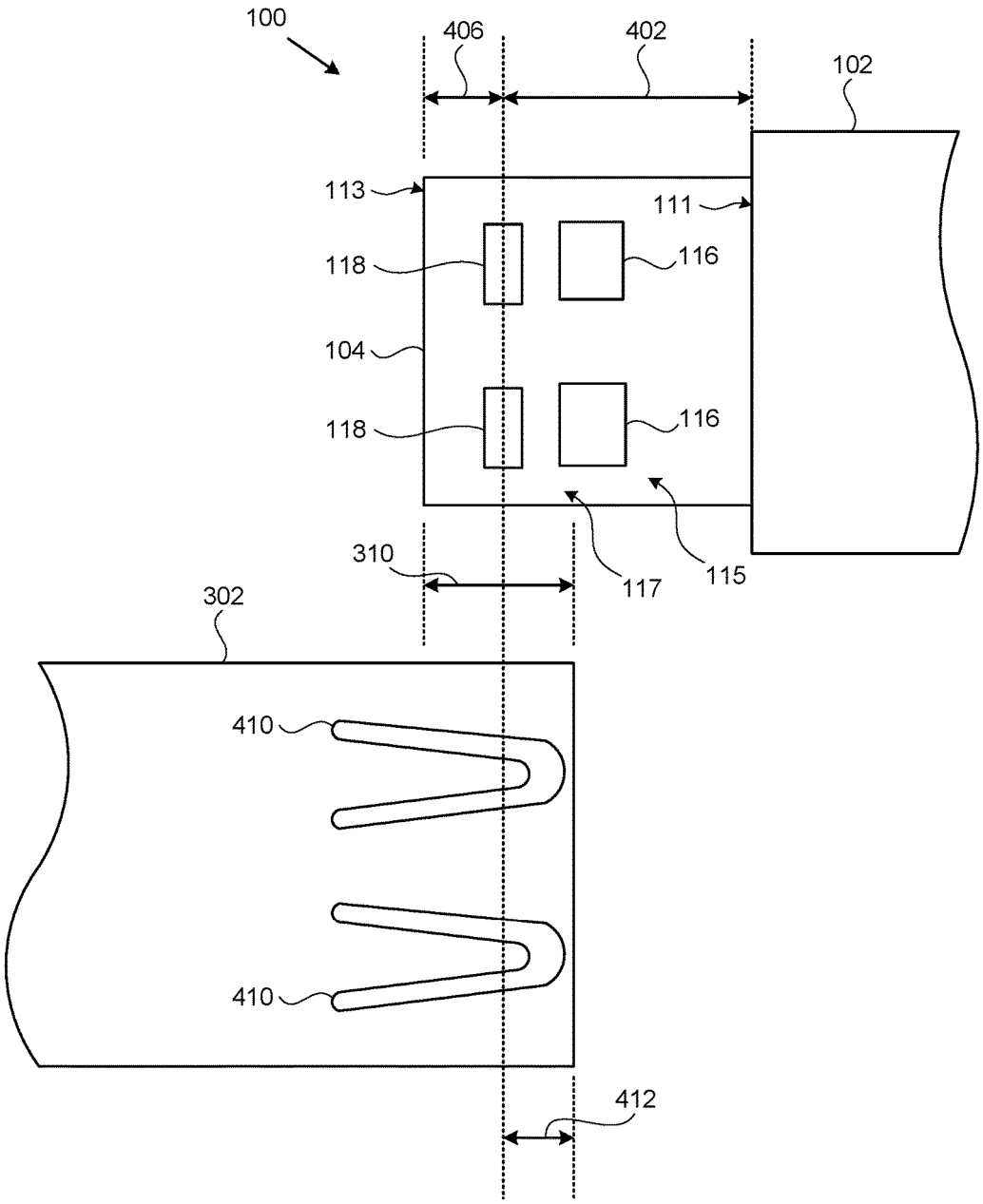
FIG. 4 is a top plan view of an insert of the electronic device of FIG. 1 and a receiver of a receiving device, according to one or more examples of the present disclosure.

In some embodiments, the position of the first retention feature 115 secures the electronic device 100 in a fully engaged mode with a receiver (e.g., the receiver 302 of FIG. 4). In the fully engaged mode, the insert housing 104 of the electronic device 100 is fully inserted into (e.g., nestably received within) the receiver to make full electrical contact with the receiver at all leads (e.g., power leads 202, 204 and data leads 206, 208 of FIG. 2) disposed on the connector 106. The second retention feature 117 is positioned in the insert housing 104 to retain the electronic device 100 in a partially engaged mode. In the partially engaged mode, the insert housing 104 is partially removed from the receiver while maintaining electrical contact with a subset of the leads of the connector 106.

The second retention feature 117 creates a delay in the removal of the electronic device 100 from the receiver. In some embodiments, the delay in the removal of the electronic device 100 is caused by the second retention feature 117 engaging a retaining feature (e.g., retaining feature 410 of FIG. 4) of the receiver after the retaining feature of the receiver has disengaged with the first retention feature 115 during a removal of the electronic device 100 from the receiver.

In some embodiments, the delay caused by the second retention feature 117 engaging with the retaining feature of the receiver, during removal of the electronic device 100 from the receiver, is up to approximately 100 milliseconds. In other embodiments, the delay may be more or less than 100 milliseconds. The delay allows for write abort handling to finalize write operations without unnecessary wear or errors due to removal or disconnect of the electronic device 100. For example, the delay may facilitate completion of a power down operation in response to detection of the partially engaged mode. The relative position and sizing of the first retention feature 115 and the second retention feature 117 to facilitate the partially engaged mode are described in greater detail below with reference to FIGS. 4-6B.

In some embodiments, the base 102 itself can be, or house, an electronic device such as a data storage or memory device. For example, base 102 may include a solid-state memory device which may be flash memory. The memory of the memory device may be disposed in the base 102. In other embodiments, the base 102 couples the insert housing 104 to a cable 120 or other structure, which may be in communication with a memory device or other electronic component with a memory. The device may, in other example embodiments, be a data storage device such as a hard disk drive (HDD), a solid-state drive (SSD), or a data storage system such as a network attached storage (NAS), etc. In other embodiments, the device may be an electronic device that in turn includes data storage or memory, or otherwise sends and/or receives data, such as, a computing device, a smartphone, a camera, a printing device, a networking device, a video/audio recording device, a gaming system, a sensor/sensing device, a medical device, etc. In some embodiments, the electronic device 100 is a component of a cable to connect separate systems or devices to send and/or receive data and/or power. In another embodiment, the electronic device 100 may be a wireless transmitter to facilitate wireless communication between separate systems or devices.

Figure 2:
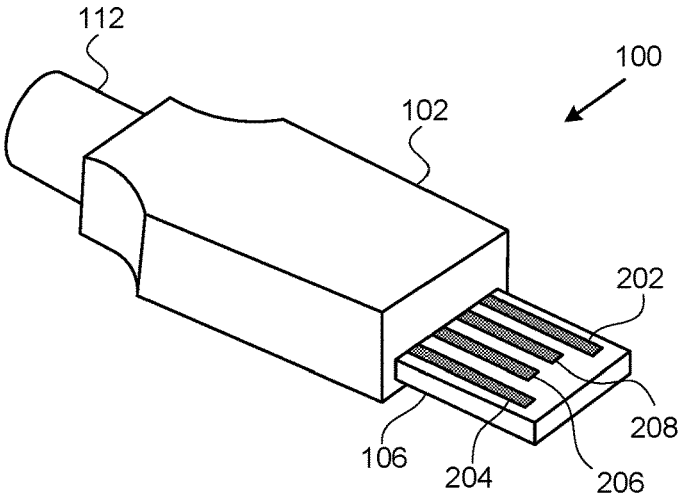
FIG. 2 is a perspective view of the electronic device of FIG. 1 with an insert housing removed, according to one or more examples of the present disclosure.

FIG. 2 illustrates the electronic device 100 of FIG. 1 with the insert housing 104 removed. The connector 106 includes at least one electrical lead disposed on a surface of the connector 106, which is accessible through the second end 113 of the insert housing 104. In particular, the at least one electrical lead of the connector 106 includes two power leads and two data leads. In the illustrated embodiment, the two power leads of the connector 106 include a power supply lead 202 and a ground lead 204. In the illustrated embodiment, the two data leads include a positive data lead 206 and a negative data lead 208.

The power supply lead 202 and the ground lead 204 are longer than the positive data lead 206 and the negative data lead 208. In some embodiments, the power supply lead 202 and the ground lead 204 are approximately 1 millimeter longer than the positive data lead 206 and the negative data lead 208. The positive data lead 206 and the negative data lead 208 are shown as disposed between the power supply lead 202 and the ground lead 204. In other embodiments, other arrangements may be used. In the illustrated embodiment, the leads 202, 204, 206, and 208 are parallel to one another. One or more of the leads 202, 204, 206, and 208 may be disposed on one or more sides of the connector 106 and may be fixed or dynamic (such as via a spring element).

Figure 3:
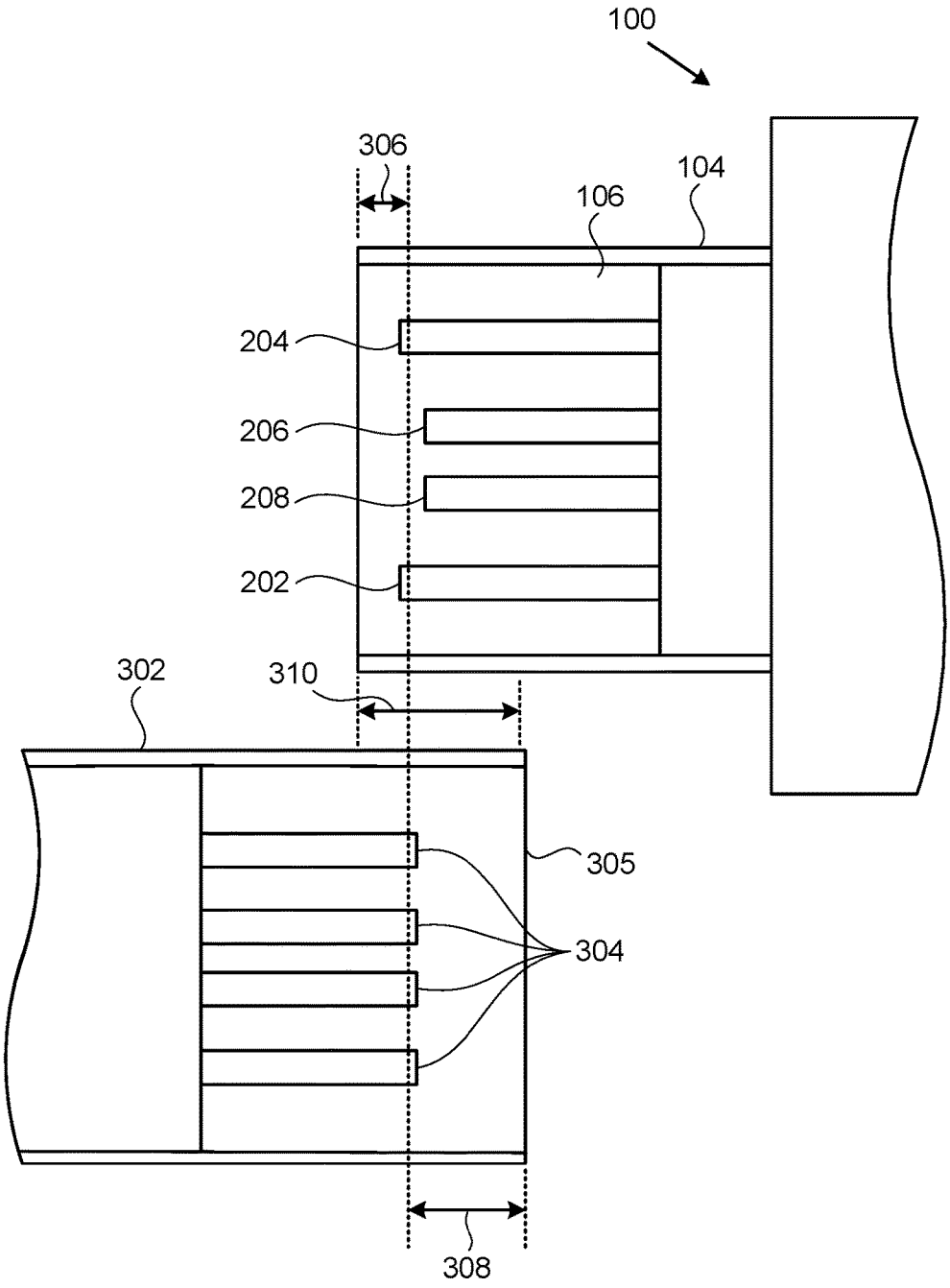
FIG. 3 is a cross-sectional top plan view of a connector of the electronic device of FIG. 1 and a connector of a receiving device, according to one or more examples of the present disclosure.

FIG. 3 illustrates a connector 106 and a receiver 302. As described above, the connector 106 includes a power supply lead 202, a ground lead 204, a positive data lead 206, and a negative data lead 208. The receiver 302 is configured to receive the connector 106 and includes receiver leads 304 disposed on a receiver connector 305 to align with, and to correspond to, the power supply lead 202, the ground lead 204, the positive data lead 206, and the negative data lead 208, respectively. In the illustrated embodiment, the positive power lead 202 and the ground lead 204 are separated from the second end 113 of the insert housing 104 by a power lead distance 306. The receiver leads 304 are separated from a front end of the receiver 302 by a receiver lead distance 308.

In the illustrated embodiment, the connector 106 of the electronic device 100 may be partially engaged with the receiver 302 when the connector 106 remains inserted within the receiver 302 at a partial engagement distance 310. This partial engagement of the connector 106 into the receiver 302 leaves the positive data lead 206 and the negative data lead 208 disconnected and maintains connection at the positive power lead 202 and the ground lead 204 in a partially engaged mode.

FIG. 4 illustrates the insert housing 104 of the electronic device 100 with the receiver 302 of a receiver. As described above, the insert housing 104 includes a first retention feature 115 and a second retention feature 117. The first retention feature 115 is formed at a first distance from the base 102 where the insert housing 104 is coupled to the base 102 at a first end 111 of the insert housing 104. The second retention feature 117 is formed in the insert housing 104 at a second distance 402 from the base 102.

In the illustrated embodiment, the receiver 302 is a universal serial bus receiver which includes a retaining feature 410 at a receiver setback distance 412. The second retention feature 117 is set back from the second end 113 of the insert housing 104 by an insert setback distance 406 defined as the distance from the center of the second retention feature 117 to the second end 113 of the insert housing 104. The insert setback distance 406 may be the same or different from the receiver setback distance 412.

In some embodiments, the insert setback distance 406 is approximately 2.91 millimeters. In other embodiments, the insert setback distance is approximately 3 millimeters. Other insert setback distances may be used. In some embodiments, the receiver setback distance 412 is approximately 2.73 millimeters. In other embodiments, the receiver setback distance 412 is more or less than approximately 2.73 millimeters.

The retaining feature 410 applies a retaining force to the insert housing 104. When the retaining feature 410 is aligned with the first retention feature 115 or the second retention feature 117, the retaining feature 410 engages the first retention feature 115 or the second retention feature 117 to apply the retaining force to the first retention feature 115 or the second retention feature 117. This force acts to removably secure the insert housing 104 within the receiver 302.

The insert setback distance 406 aligns the retaining feature 410 with the second retention feature 117 in the partially engaged mode to preserve connection of the power leads 202 and 204 on the connector 106 with the receiver 302 after the data leads 206 and 208 have been disconnected from the receiver 302. The retaining feature 410 may also be engaged with the first retention feature 115 in the fully engaged mode to preserve connection of the positive power lead 202 and the ground lead 204 and the positive data lead 206 and the negative data lead 208 of the connector 106 with the receiver 302. In some embodiments, the partial engagement distance 310 is approximately 5.64 millimeters. In other embodiments, the partial engagement distance 310 is more or less than approximately 5.64 millimeters.

As the insert housing 104 is withdrawn from a fully engaged mode with the receiver 302, the retaining feature 410 disengages from the first retention feature 115 and then engages with the second retention feature 117. The engagement of the retaining feature 410 with the second retention feature 117 causes a delay in the withdrawal process. The delay may be up to approximately 100 milliseconds or more.

Figure 5:
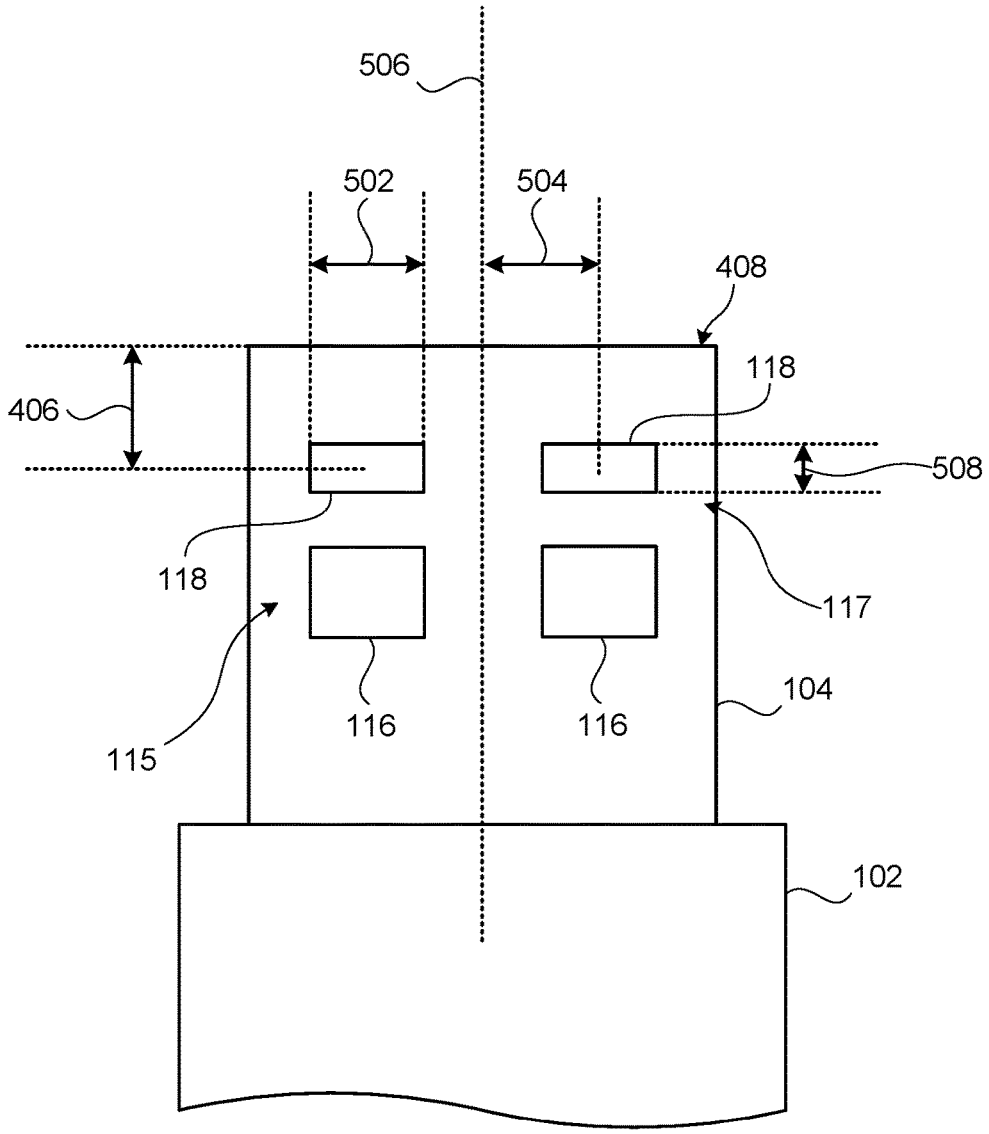
FIG. 5 is a top plan view of the retention structures of the insert of the electronic device of FIG. 1, according to one or more examples of the present disclosure.

Referring to FIG. 5, the illustrated embodiment depicts the insert housing 104 coupled to the base 102. The insert housing 104 includes first retention feature 115 and second retention feature 117. In the illustrated embodiment, the first retention feature 115 includes two primary cutouts 116 which have a rectangular geometry and the second retention feature 117 includes two secondary cutouts 118 which also have a rectangular geometry.

In the illustrated embodiment, the cutouts 116 of first retention feature 115 and the cutouts 118 of the second retention feature 117 have approximately the same width while, in other embodiments, the widths of the cutouts 116 of the first retention feature 115 and the cutouts 118 of the second retention feature 117 are different from one another. In one example, the width 502 of the secondary cutouts 118 is 2.5 millimeters. A center distance 504 from the center of the secondary cutouts 118 of the second retention feature 117 to a center line 506 of the insert housing 104 may be approximately 3.0 millimeters. In some embodiments, the length 508 of the secondary cutouts 118 of the second retention feature 117 is approximately 1.0 millimeter.

While the cutouts 116, 118 of the first and second retention features 115 and 117, respectively, are shown as generally rectangular in geometry, in other embodiments, at least one of the cutouts 116, 118 of the first and second retention features 115 and 117 includes a non-rectangular geometry. In some embodiments, the first and second retention features 115 and 117 are indentations or partial cutouts. Other shapes and geometries may be incorporated.

Figure 6A:
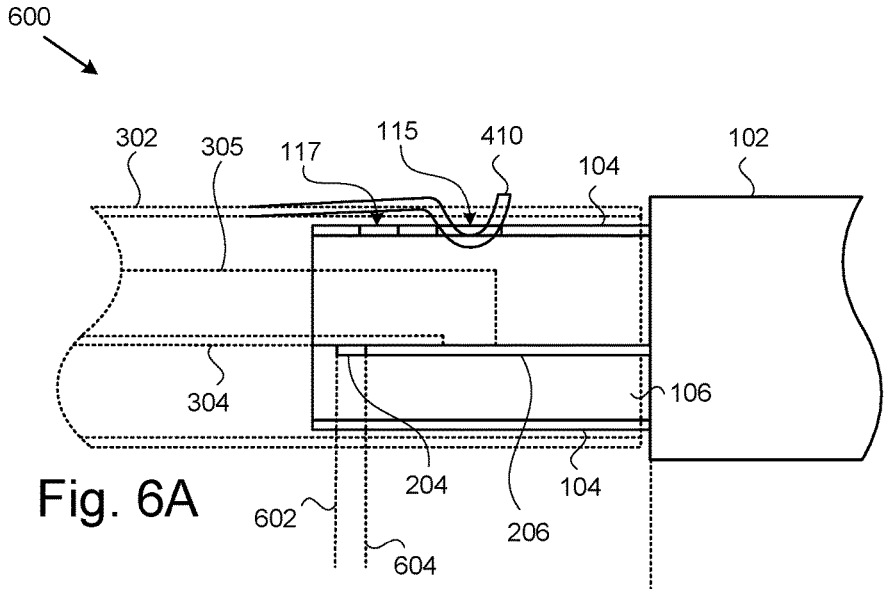
FIG. 6A is a side elevation view of a cross-section of the insert housing coupled with the receiver in a fully engaged mode, according to one or more examples of the present disclosure.

FIG. 6A illustrates a cross-sectional view of data transfer system 600 with the insert housing 104 of the electronic device 100 inserted into the receiver 302 in a fully engaged mode. In the illustrated embodiment, the retaining feature 410 of the receiver 302 is engaged with the first retention feature 115 of the insert housing 104. In this position, the ground lead 204 and the positive data lead 206 are in electrical contact with the receiver leads 304 disposed on a receiver connector 305. The negative data lead 208 and power supply lead 202 are also connected in this mode but are not shown in the cross-section. The receiver leads 304 extend across both a power lead threshold 602 and a data lead threshold 604 establishing electrical contact with both types of leads.

Figure 6B:
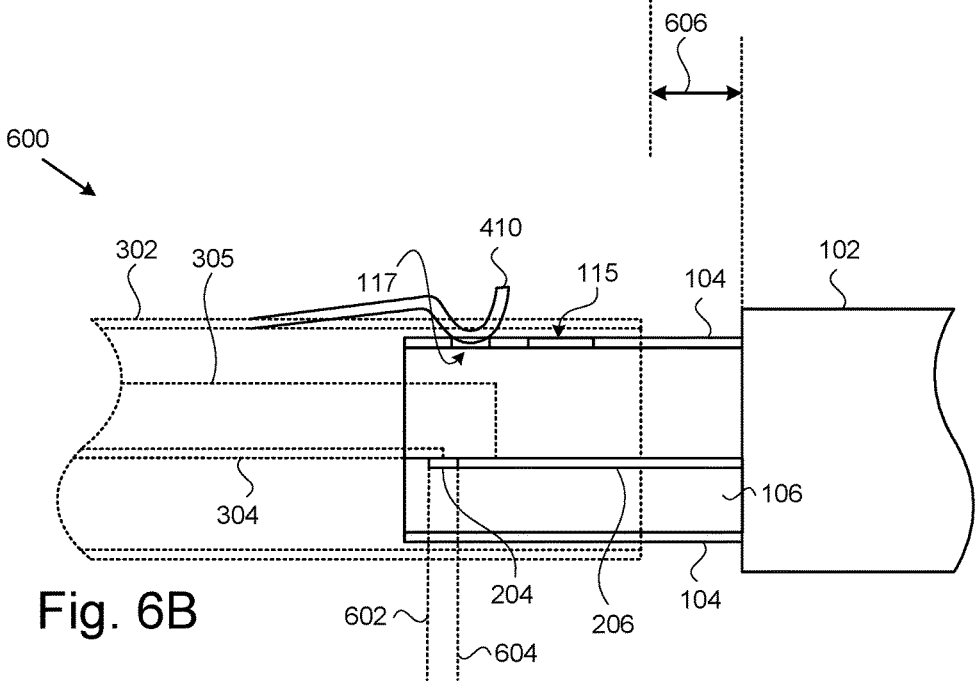
FIG. 6B is a side elevation view of a cross-section of the insert housing coupled with the receiver in a partially engaged mode, according to one or more examples of the present disclosure.

In FIG. 6B, the insert housing 104 is withdrawn from the receiver 302 a delay distance 606. The delay distance 606 is the distance between disengagement of the retaining feature 410 of the receiver from the first retention feature 115 of the insert housing 104 to engagement of the retaining feature 410 with the second retention feature 117 of the insert housing 104. In the illustrated position, the data transfer system 600 is in a partially engaged mode. In the partially engaged mode, the receiver leads 304 are outside of the data lead threshold 604 and thus disconnected from the negative data lead 206 but remains within the power lead threshold 602 maintaining electrical contact with the ground lead 204. This facilitates completion of a power down operation or other protective process.

Figure 7:
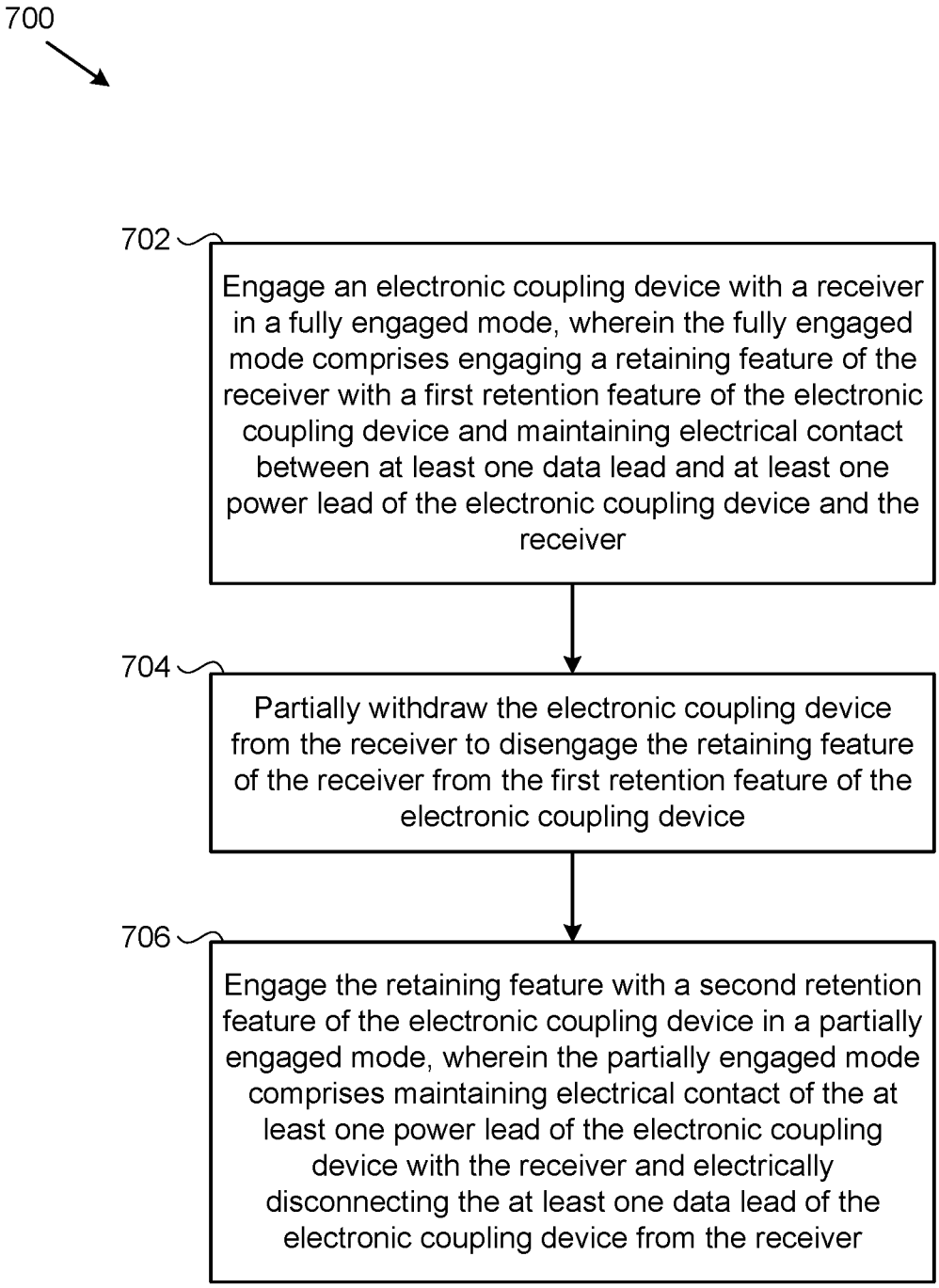
FIG. 7 is a flow diagram of a method of using an electronic device with a receiver, according to one or more examples of the present disclosure.

FIG. 7 illustrates a flow diagram of a method 700 of using an electronic device 100 with a receiver 302. The method 700 includes engaging 702 an electronic device 100 with a receiver 302 in a fully engaged mode. The fully engaged mode includes engaging a retaining feature 410 of the receiver 302 with a first retention feature 115 of the electronic device 100 and maintaining electrical contact between at least one data lead 206 and 208 and at least one power lead 202 and 204 of the electronic device 100 and the receiver 302.

The method 700 also includes partially withdrawing 704 the electronic device 100 from the receiver 302 to disengage the retaining feature 410 of the receiver 302 from the first retention feature 115 of the electronic device 100.

The method 700 also includes engaging 706 the retaining feature 410 with a second retention feature 117 of the electronic device 100 in a partially engaged mode. The partially engaged mode includes maintaining electrical contact of the at least one power lead 202 and 204 of the electronic device 100 with the receiver 302 and electrically disconnecting the at least one data lead 206 and 208 of the electronic device 100 from the receiver 302.

In the above description, certain terms may be used such as "up," "down," "upper," "lower," "horizontal," "vertical," "left," "right," "over," "under" and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise. Further, the term "plurality" can be defined as "at least two."

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

The schematic flow chart diagrams included herein are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

The present subject matter may be embodied in other specific forms without departing from its spirit or essential characteristics. The described embodiments are to be considered in all respects only as illustrative and not restrictive. All changes which come within the meaning and range of equivalency of the claims are to be embraced within their scope.

What is claimed is:

1. An electronic device comprising:

a base;

an insert housing coupled to the base at a first end of the insert housing, the insert housing comprising:

a first side extending in an outward direction from the base, the first side comprising:

a first retention feature formed in the first side at a first distance from the base; and a second retention feature formed in the first side at a second distance from the base, wherein the first distance is less than the second distance;

wherein the first side partially defines a second end of the insert housing opposite the first end and open to allow access to an interior of the insert housing; and a connector coupled to the base and disposed within the interior of the insert housing, the connector comprising at least two electrical leads disposed on a surface of the connector accessible through the second end of the insert housing;

wherein the first retention feature comprises two primary cutouts in the first side of the insert housing and the second retention feature comprises two secondary cutouts in the first side of the insert housing at least partially aligned with the two primary cutouts in the outward direction.

2. The electronic device according to claim 1, wherein each of the two secondary cutouts have a width of approximately 2.5 millimeters and a length of approximately 1 millimeter, wherein the width is measured perpendicular to the outward direction and the length is measured parallel to the outward direction.

3. The electronic device according to claim 1, wherein a center of each of the two secondary cutouts is approximately 3 millimeters from the second end of the insert housing and approximately 3 millimeters from a centerline of the first side of the insert housing, wherein the centerline extends in the outward direction from the base along a center of the first side of the insert housing.

4. The electronic device according to claim 3, wherein the center of each of the two secondary cutouts is approximately 2.91 millimeters from the second end of the insert housing.

5. The electronic device according to claim 1, wherein the first retention feature is positioned in the insert housing to retain the electronic device in a fully engaged mode, relative to a receiver configured to receive the electronic device, and the second retention feature is positioned in the insert housing to retain the electronic device in a partially engaged mode, relative to the receiver.

6. The electronic device according to claim 5, wherein the first retention feature and the second retention feature are sized to engage with a retaining feature of the receiver.

7. The electronic device according to claim 1, wherein the at least two electrical leads comprises at least one power lead having a first length and at least one data lead having a second length, wherein the first length is greater than the second length.

8. The electronic device according to claim 7, wherein the first retention feature is positioned in the insert housing to releasably retain both the at least one power lead and the at least one data lead in electrical contact with a receiver configured to receive the electronic device and the second retention feature is positioned in the insert housing to releasably retain the at least one power lead in electrical contact with the receiver and to releasably retain the at least one data lead out of electrical contact with the receiver.

9. The electronic device according to claim 7, wherein the electronic device is configured to perform a power down or protective operation in response to detection that the at least one power lead is in electrical contact with a receiver and detection that the at least one data lead is disconnected from the receiver.

10. The electronic device according to claim 1, wherein at least one of the first retention feature and the second retention feature is also formed in a third side of the insert housing to approximately mirror a position of the at least one of the corresponding first retention feature and the second retention feature formed in the first side of the insert housing.

11. The electronic device according to claim 1, further comprising a data storage device.

12. The electronic device according to claim 11, further comprising a cable connecting the data storage device to the electronic device.

13. A cable comprising the electronic device according to claim 1.

14. A system comprising:

a receiver comprising a retaining feature disposed within the receiver; and an electronic device comprising:

a first retention feature formed in a first side of the electronic device, wherein the first retention feature is positioned to engage with the retaining feature of the receiver in a fully engaged mode;

a second retention feature formed in the first side of the electronic device, wherein the second retention feature is positioned to engage with the retaining feature of the receiver in a partially engaged mode; and a connector comprising at least one power lead and at least one data lead disposed on a surface of the connector to electrically connect with the receiver, wherein the at least one power lead and the at least one data lead are in electrical contact with the receiver in the fully engaged mode and the at least one power lead is in electrical contact with the receiver while the at least one data lead is disconnected from the receiver in the partially engaged mode.

15. The system according to claim 14, wherein the electronic device is a universal serial bus device.

16. The system according to claim 14, wherein the electronic device comprises a data storage device.

17. The system according to claim 14, wherein the at least one power lead comprises a power supply lead and a ground lead and the at least one data lead comprises a positive data lead and a negative data lead.

18. The system according to claim 17, wherein the power supply lead, the ground lead, the positive data lead, and the negative data lead are parallel to one another and the positive data lead and the negative data lead are disposed between the power supply lead and the ground lead.

19. The system according to claim 14, wherein the at least one power lead is approximately 1 mm longer than the at least one data lead.

20. The system according to claim 14, wherein the second retention feature is sized to engage with the retaining feature of the receiver to delay removal of the electronic device from the receiver.

21. The system according to claim 14, wherein the electronic device is configured to perform a power down or protective operation in response to detection that the at least one power lead is in electrical contact with the receiver and detection that the at least one data lead is disconnected from the receiver.

22. The system according to claim 14, wherein the second retention feature is configured to delay removal of the electronic device from the receiver by up to approximately 100 milliseconds.

23. A method comprising:

engaging an electronic device with a receiver in a fully engaged mode, wherein the fully engaged mode comprises engaging a retaining feature of the receiver with a first retention feature of the electronic device and maintaining electrical contact between at least one data lead and at least one power lead of the electronic device and the receiver;

partially withdrawing the electronic device from the receiver to disengage the retaining feature of the receiver from the first retention feature of the electronic device; and engaging the retaining feature with a second retention feature of the electronic device in a partially engaged mode, wherein the partially engaged mode comprises maintaining electrical contact of the at least one power lead of the electronic device with the receiver and electrically disconnecting the at least one data lead of the electronic device from the receiver.

24. An electronic device comprising:

a base;

an insert housing coupled to the base at a first end of the insert housing, the insert housing comprising:

a first side extending in an outward direction from the base, the first side comprising:

a first retention feature formed in the first side at a first distance from the base; and a second retention feature formed in the first side at a second distance from the base, wherein the first distance is less than the second distance;

wherein the first side partially defines a second end of the insert housing opposite the first end and open to allow access to an interior of the insert housing; and a connector coupled to the base and disposed within the interior of the insert housing, the connector comprising at least two electrical leads disposed on a surface of the connector accessible through the second end of the insert housing;

wherein:

the at least two electrical leads comprises at least one power lead having a first length and at least one data lead having a second length, wherein the first length is greater than the second length; and the first retention feature is positioned in the insert housing to releasably retain both the at least one power lead and the at least one data lead in electrical contact with a receiver configured to receive the electronic device and the second retention feature is positioned in the insert housing to releasably retain the at least one power lead in electrical contact with the receiver and to releasably retain the at least one data lead out of electrical contact with the receiver.

* * * * *